US005832819A

United States Patent [19]

Widman

[11] Patent Number: 5,832,819

[45] Date of Patent: Nov. 10, 1998

[54] METHOD FOR TRANSFERRING AN IMAGE ONTO AN OBJECT HAVING CURVED SURFACES

[76] Inventor: Marshall Widman, 9838 Aberdeen, Leawood, Kans. 66206

[21] Appl. No.: 788,966

[22] Filed: Jan. 24, 1997

[51] Int. Cl.[6] ..... B41C 1/06

[52] U.S. Cl. ..... 101/34; 101/33

[58] Field of Search ..... 101/34, 33, 35, 101/41, DIG. 40; 156/146

[56] References Cited

U.S. PATENT DOCUMENTS

| | | | |
|---|---|---|---|
| 2,002,698 | 5/1935 | Kruczek | 101/35 |
| 2,005,787 | 6/1935 | Humphrey | 101/35 |
| 2,684,775 | 7/1954 | Hofe | 101/41 |
| 3,946,195 | 3/1976 | Lyons et al. | 101/35 |
| 4,063,878 | 12/1977 | Weeks | 101/470 |
| 4,163,421 | 8/1979 | Sihota | 101/41 |
| 4,541,340 | 9/1985 | Peart et al. | 101/32 |
| 4,610,950 | 9/1986 | Milliken | 430/306 |
| 5,443,001 | 8/1995 | Keller et al. | 101/35 |

FOREIGN PATENT DOCUMENTS

| | | | |
|---|---|---|---|
| 0086263 | 5/1986 | Japan | 101/DIG. 40 |

*Primary Examiner*—Edgar S. Burr

*Assistant Examiner*—Anthony H. Nguyen

*Attorney, Agent, or Firm*—Shook, Hardy & Bacon L.L.P.

[57] ABSTRACT

A method for transferring an image from a color photograph onto an object having multiple curved surfaces utilizes a backing sheet to protect the object from the heat required for thermal transfer. The object is disposed in a press assembly near the backing sheet so that the image attached to the backing sheet may be aligned with the target surface on the object. Then, the backing sheet is moved toward the target surface so that the image contacts the target surface at a desired position. The backing sheet is further pressed against the object to deform the target surface until it is substantially flat. Heat applied to the backing sheet and the image then causes the pigment contained in the image to be transferred onto the target surface to create a mirror image without damaging the object. When the backing plate is removed, the object will substantially regain its original curvature. The method for transferring an image from a color photocopy is identical to the method for a photograph except that the use of a backing sheet is optional. After the photocopy image has been transferred, it is preferably immersed in water and then alcohol. Alternatively, an image may be transferred onto an object such as a baseball by cutting a flap of the baseball away from the core to obtain a substantially flat target surface. Following thermal transfer, the flap can be reattached to the core to obtain the original appearance of the baseball.

22 Claims, 3 Drawing Sheets

Fig. 1.
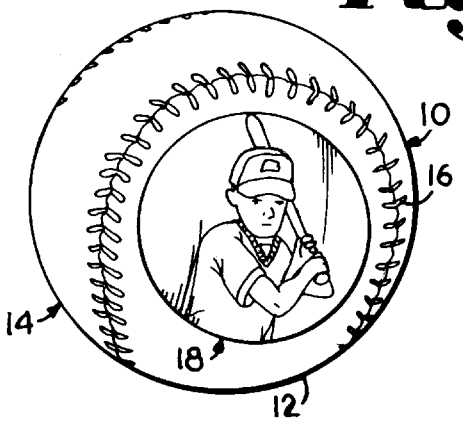
Fig. 2.
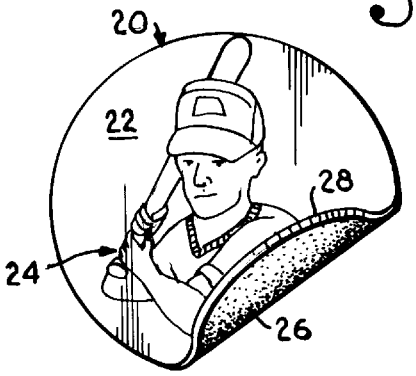
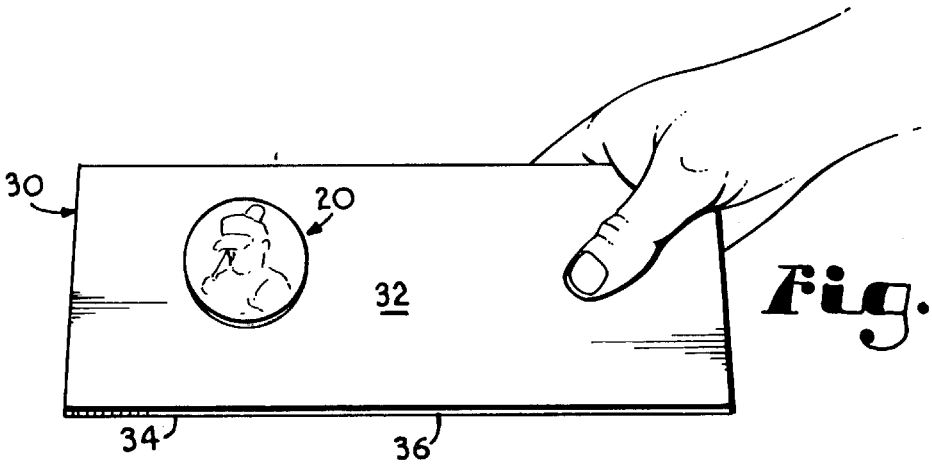
Fig. 3.
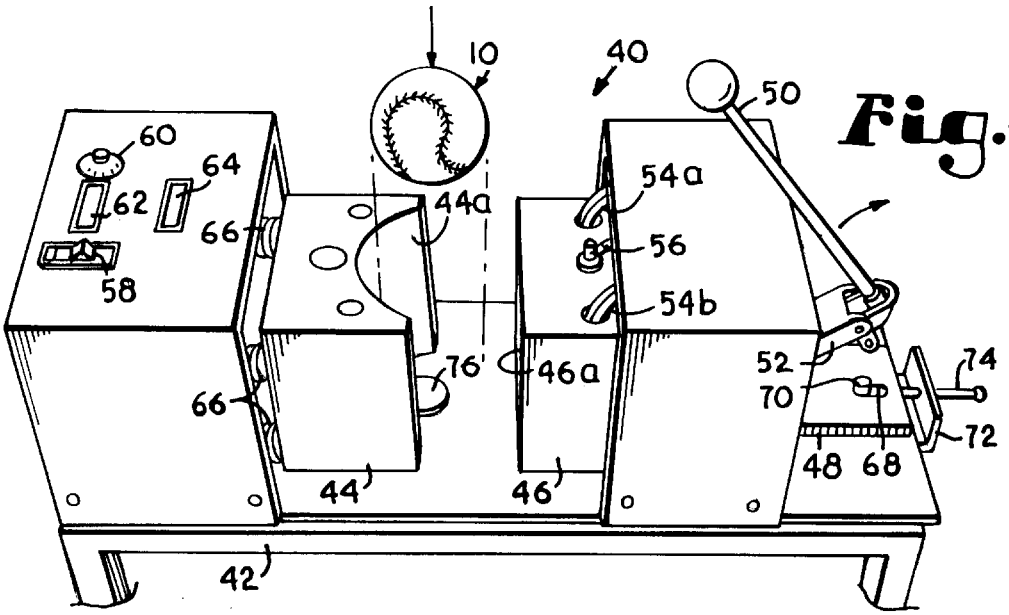
Fig. 4.

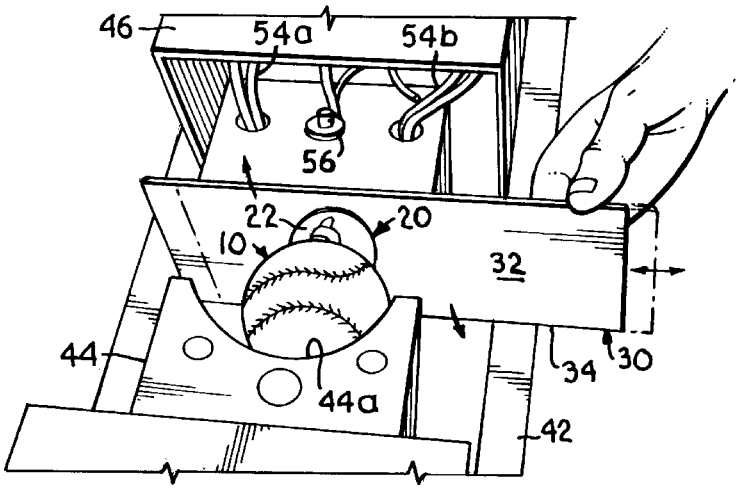
Fig. 5.
Fig. 6.
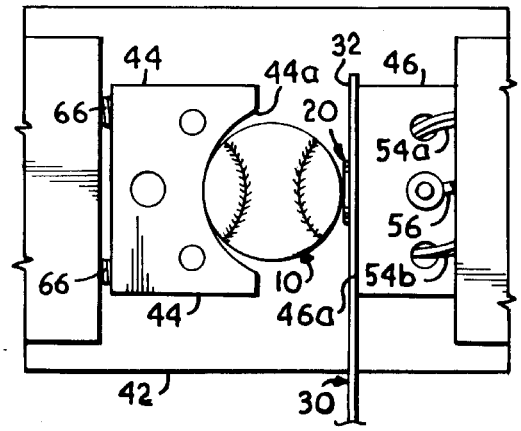
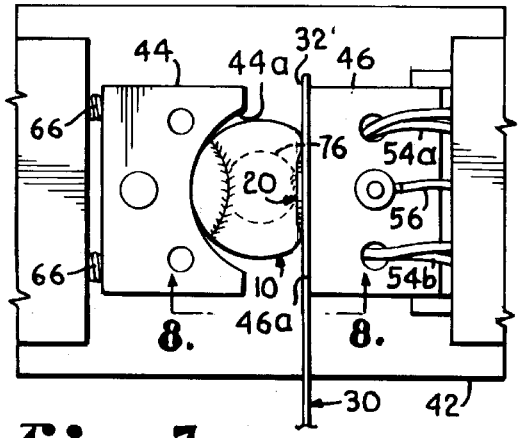
Fig. 7.
Fig. 8.
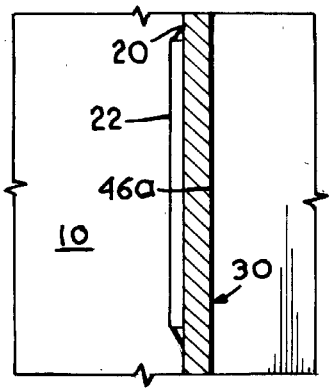
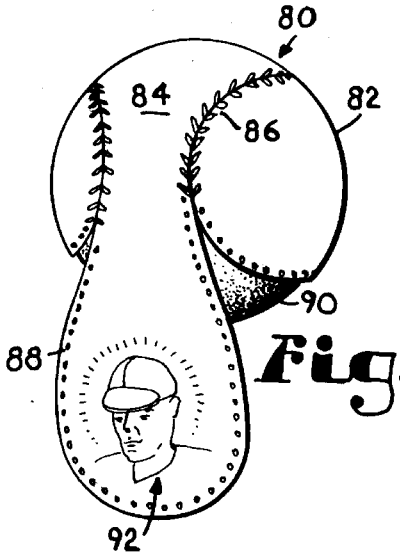
Fig. 9.

METHOD FOR TRANSFERRING AN IMAGE ONTO AN OBJECT HAVING CURVED SURFACES

BACKGROUND OF THE INVENTION

This invention relates in general to a method and apparatus for transferring an image onto an object having curved surfaces and, more particularly, to a method and apparatus for effecting thermal transfer of an image onto a surface which is generally convex in two directions.

There is a significant demand for novelty items such as coffee mugs which bear a picture of a family member or a celebrity. For example, many grandparents would purchase a coffee mug with a picture of their grandchild on it. Similarly, sports memorabilia collectors routinely buy, sell and trade baseballs and other souvenirs which prominently display pictures of star athletes on them. The athlete may even be more inclined to autograph a baseball or other item if it has their picture on it.

Naturally, an item presenting a flat surface, such as a card, is the easiest surface on which to place the desired image or picture. Nevertheless, photographic images have been successfully placed on items such as coffee mugs, which have a curved surface. Specifically, the pigment or coloring in a photograph has been transferred onto a mug through sublimation by pressing the photograph against the mug surface and applying heat.

However, those skilled in the art have encountered numerous problems when attempting to place pictures or images onto other novelty items such as baseballs. A baseball presents surfaces that are generally convex in two directions, and it is thus more difficult to place an image on a baseball than to place an image on a mug, which curves in only one direction. Although an image can be printed onto the cover of a baseball, the cost for doing so is prohibitively high unless thousands of souvenir baseballs bearing the same image are produced. Such mass production is not practical for printing the image of a friend or family member on an object. Moreover, the quality of the image printed on a souvenir baseball may not be satisfactory unless a sophisticated, and expensive, printing process is employed.

Further, in addition to the problems attributable to the configuration of a baseball, the sublimation process used with coffee mugs is not a viable alternative to the expensive process for printing images on baseballs and similar items because the heat required to achieve sublimation will melt the cover of the baseball. Thus, there is a need for a cost effective means for placing a selected image onto an object which curves in two directions without damaging the object.

SUMMARY OF THE INVENTION

The present invention overcomes the problems and limitations set forth above by providing a method and apparatus for transferring an image onto an object having a surface that curves in two directions. The method of the present invention may be adapted to transfer an image, including images from photographs and photocopies, onto a curved object.

If the image is in a color photograph, the image is attached to a backing sheet so that it faces away from the backing sheet. A target surface is selected on the baseball or other curved object for receiving the pigment contained in the photograph. The backing sheet with the attached image is aligned with the target surface and moved toward a desired position on the target surface until the image contacts the desired position. Then, the backing sheet with the attached image is pressed against the target surface at the desired position so that the image rests firmly against the target surface. Finally, the heat provided to the image causes the pigment contained in the image to transfer from the image to the target surface through sublimation. Thus, the transferred image is a mirror image of the original image.

Prior to sublimation, the object is deformed so that the target surface becomes substantially flat. Preferably, this will be accomplished by compressing the object within a press assembly until the target surface has been substantially flattened. The object would then be reformed after sublimation has occurred so that the original curvature of the target surface is substantially returned thereto. If the object is a baseball, an alternative means for obtaining a flattened target surface would involve cutting the stitching associated with the target surface and removing at least a portion of the cover so that a flat target surface is available for the sublimation process. After the image has been transferred, an adhesive may be used to glue the underside of the target surface back into place. Alternatively, the target surface could be restitched. Other methods for deforming and reforming the object will be dictated by the nature of the object. For example, a volleyball or other inflatable ball could be slightly deflated to facilitate the flattening of the target surface.

The same transfer process employed for a photograph may also be employed if the image is a photocopy, such as a color photocopy of a color photograph. However, it is not necessary to use a backing sheet when transferring the image from a photocopy onto a curved object. Preferably, the image transfer process for a photocopy involves the additional step of briefly immersing the image in rubbing alcohol after a cooling period to separate the photocopy paper from the curved object.

The "image" may be a photograph, a photocopy or any other graphical representation capable of thermal transfer onto a curved object. Further, the image itself may contain text, or a textual message could be separately transferred onto the object. The toner, dye or other coloring contained in the image is referred to herein as "pigment."

Accordingly, it is an object of the present invention to provide a cost effective method and apparatus for transferring an image onto an object having a "double" convex surface (i.e., curving in two directions).

It is another object of the present invention to provide a method and apparatus for transferring an image onto an object having a double convex surface so that the object is not damaged.

It is yet another object of the present invention to provide a method and apparatus wherein a backing sheet is provided for positioning the image on the curved object. A related object of the present invention is to provide a method and apparatus for transferring an image onto a curved object through a sublimation process wherein a backing sheet is utilized to protect the object from heat damage.

Yet another object of the present invention is to provide a method and apparatus for transferring an image onto an object having a double convex target surface wherein the object is deformed to provide a target surface that is substantially flat. A related object of the present invention is to provide a method and apparatus for transferring an image onto a curved surface wherein the object is reformed following the transfer so that the target surface substantially regains its original curvature.

These and other related objects of the present invention will become readily apparent upon further review of the specification and drawings. To accomplish the objects of the present invention, a method for transferring an image onto an object having a double convex surface is provided wherein a generally planar image containing pigment is aligned with a target surface on the object, the image is moved toward a desired position on the target surface, the image is pressed against the target surface at the desired position and the image is heated so that the pigment can be transferred from the image to the target surface to produce a mirror image on the target surface. In another aspect, the objects of the present invention are accomplished by providing an apparatus for transferring an image onto an object having at least one curved surface, wherein the apparatus comprises a press assembly having a base, a die and a die plate defining a region in which the object may be disposed, means for pressing the image against a selected surface on the object so that the pigment contacts the selected surface and heater means coupled with the press assembly for providing heat to the image so that the pigment can be transferred to the selected surface.

BRIEF DESCRIPTION OF THE DRAWINGS

In the accompanying drawings which form a part of the specification and are to be read in conjunction therewith and in which like reference numerals are used to indicate like parts and the various views:

FIG. 1 is a perspective view of a souvenir baseball produced in accordance with a preferred embodiment of the present invention;

FIG. 2 is a front elevational view of an image for use in accordance with a preferred embodiment of the present invention, a portion of the image being folded over to reveal the back side of the image;

FIG. 3 is a perspective view of the image of FIG. 2 attached to the front side of a backing sheet in accordance with a preferred embodiment of the present invention;

FIG. 4 is a perspective view of an apparatus in accordance with a preferred embodiment of the present invention wherein an arrow indicates the range of movement of a lever arm and a second arrow and corresponding set of broken lines indicate the placement of a baseball within the apparatus;

FIG. 5 is a partial perspective view of the apparatus shown in FIG. 4 having a baseball disposed therein and illustrating the backing sheet shown in FIG. 3 being manually aligned with a target surface on the baseball as indicated by arrows and broken lines;

FIG. 6 is a partial top plan view of the apparatus of FIG. 4 wherein the image attached to the backing sheet is contacting the target surface with which it is aligned in accordance with a preferred embodiment of the present invention;

FIG. 7 is a partial top plan view of the apparatus of FIG. 4 wherein the backing sheet with the attached image is pressed against the target surface in accordance with a preferred embodiment of the present invention so as to deform the baseball and provide a substantially flattened target surface;

FIG. 8 is an enlarged elevational view taken along line 8—8 of FIG. 7 showing the image attached to the backing sheet;

FIG. 9 is a perspective view of a souvenir baseball produced in accordance with an alternative embodiment of the present invention with an image being displayed on a portion of the cover that has been cut away from the baseball to reveal its core;

DETAILED DESCRIPTION OF A PREFERRED EMBODIMENT

Figure 10:
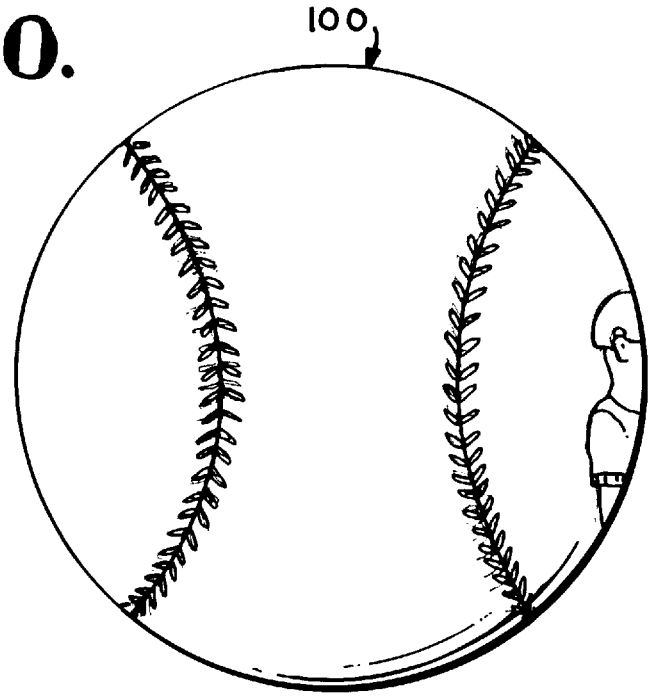
FIG. 10 is a perspective view of a souvenir softball produced in accordance with a preferred embodiment of the present invention.

Referring to the drawings in greater detail, and initially to FIG. 1, the souvenir baseball of the present invention is designated generally by reference numeral 10. The baseball 10 comprises a curved surface 12, a cover 14, stitching 16 and an image 18, which has been transferred onto surface 12. Image 18 was derived from an image 20 shown in FIG. 2 and is a mirror image of 20. Image 20, which could be either a color photograph or a color photocopy of a color photograph, has a front side 22 containing pigment 24 and a back side 26. Front side 22 is separated from back side 26 by an edge 28.

In a preferred embodiment of the present invention, image 20 is a color photograph that is transferred onto baseball 10 through sublimation. As shown in FIG. 3, photograph 20 is placed on a generally planar backing sheet 30 having a front side 32 and a back side 34. Front side 32 and back side 34 are separated by an edge 36 which defines the perimeter of backing sheet 30. Prior to the sublimation process, back side 26 of image 20 is attached to front side 32 of backing sheet 30. Preferably, this is accomplished by applying an adhesive to the underside 26 of image 20.

Referring now to FIGS. 4–8, an apparatus 40 is shown for carrying out the sublimation process of the present invention. Apparatus 40 includes a support platform 42, a spring-mounted die 44 and a moveable die plate 46. Base 42 presents a generally planar horizontal surface to which is mounted a track 48 which accommodates lateral horizontal movement of die plate 46. Lever actuator 50 is coupled with die plate 46 through linkage 52. Electrical leads 54*a* and 54*b* are coupled with an electrical energy source to provide resistance heating to die plate 46 (the heater is not shown). Conductor 56 is an electrical ground wire. On/off switch 58 controls the flow of electricity to the die plate heater and knob 60 is a thermostat control. Lights 62 and 64 provide a visual indication of when the resistance heater is on and when it has achieved a desired preset temperature. Die 44 is mounted for limited reciprocal horizontal movement against the resistance of four identical mounting springs 66, three of which are visible in FIG. 4.

Track 48 is provided with an elongated slot 68 which receives a stationary retaining pin 70. Bracket 72 is rigidly mounted on base 42 and receives screw 74 in a threaded opening. Screw 74 may be adjusted toward or away from track 48 so as to present a stop. Adjustment of screw 74 determines the length of movement of die plate 46 in response to movement of lever actuator 50.

It is to be noted that the face 46*a* of die plate 46 presents a smooth planar vertical surface. This is to be contrasted with the face 44*a* of die 44 which is concave and has a radius of curvature generally corresponding to the radius of curvature of baseball 10. A cup 76 centrally positioned relative to die face 44*a* provides a seat for placement of baseball 10.

In another preferred embodiment of the present invention, image 20 is a color photocopy of a color photograph. This color photocopy uses the same type of transfer paper that those skilled in the art would use for transferring pictures onto T-shirts. Generally, the process for transferring pigment or toner 24 from photocopy 20 to baseball 10 is nearly identical to the sublimation process for the photographic image. However, it has been found that the use of a backing sheet 30 to protect baseball 10 is not necessary for the photocopy transfer process. Even though sheet 30 is unnecessary, it may nevertheless be desirable to mount photocopy 20 on sheet 30 to provide additional support during the image transfer process.

Another souvenir baseball 80 is shown in FIG. 9. Baseball 80 has a curved surface 82, a cover 84, stitching 86, a flap 88, a core 90 and an image 92. In FIG. 9, flap 88 has been separated from core 90 by cutting the stitching 86 associated with flap 88. In this way, flap 88, which was curved like surface 82 prior to being separated from core 90, can now be employed as a flat surface. Accordingly, an image such as image 20 can be pressed against flap 88 using backing sheet 30. As discussed above, the use of sheet 30 is optional if image 20 is a color photocopy. Through thermal transfer, a mirror image 92 is transferred onto flap 88 and yields the souvenir baseball 80 shown in FIG. 9. Then, flap 88 is reattached to core 90 through adhesion or restitching.

In operation, a preferred embodiment of the present invention is carried out by first placing baseball 10 within apparatus 40, as shown in FIG. 4, so that baseball 10 rests on cup 76. Once a target surface on ball 10 has been selected, ball 10 is positioned against curved face 44*a* so that the target surface faces planar face 46*a*. Then, backing sheet 30 with attached photographic image 20 is disposed between the target surface of baseball 10 and planar face 46*a* as shown in FIG. 5. Image 20 is aligned with a desired position on the target surface by manually adjusting the location of the backing sheet.

Once image 20 has been aligned with a desired position on the target surface of baseball 10, actuator 50 (FIG. 4) is manipulated to move die plate 46 toward baseball 10 along track 48. Since backing sheet 30 with attached image 20 is disposed intermediate the target surface and face 46*a*, the movement of plate 46 in the direction of die 44 will eventually result in contact between image 20 and the target surface. However, the initial contact between image 20 and baseball 10, which is best shown in FIG. 6, involves only a portion of image 20 because of the curvature of baseball 10. Therefore, lever 50 is manipulated for further movement of plate 46 in the direction of die 44 until the target surface is substantially flat as shown in FIG. 7. The pressure required to flatten the target surface of a round ball will vary considerably, but in general apparatus 40 should be capable of delivering between 10 and 100 pounds of pressure. A typical baseball will require 60–70 pounds of pressure to flatten the target surface. Springs 66 accommodate limited movement of die 44 in response to movement of the die plate 46 against the ball which assures proper contact between the backing sheet and the ball. At this point, image 20 has full surface contact with the target surface of baseball 10, as shown in FIGS. 7–8.

With image 20 firmly pressed against the target surface of baseball 10, the thermal transfer process may be initiated. Heat is applied to image 20 upon actuation of switch 58 and in response to the temperature setting indicated by knob 60. While the specific temperature required to achieve image transfer will vary over a wide range depending upon the ball covering, die plate 46 should be capable of reaching temperatures in the range of 350 to 750 degrees Fahrenheit. For a vinyl covered baseball, a temperature of 475 to 525 degrees Fahrenheit is preferred. The heat source is located in proximity to member 50 so that the heat will be directed to image 20 while baseball 10 remains partially insulated. Backing sheet 30 absorbs some of the heat directed to image 20 which would otherwise be absorbed by the cover of baseball 10. Without backing sheet 30, it has been found that the vinyl cover of baseball 10 would begin to melt under the intense heat required for sublimation of the pigment contained in photograph 20. Thus, the metal backing sheet 30, which is preferably made of aluminum, has been provided to partially insulate the cover of baseball 10 to keep it from melting. Once the threshold temperature for sublimation has been attained, the sublimation process will occur nearly instantaneously so that a mirror image of image 20 is transferred onto the target surface of baseball 10. Then, lever 50 is manipulated in a reverse orientation to move die plate 46 away from die 44 thus allowing baseball 10 to substantially regain its original curvature. It has been found that compressing baseball 10 for the relatively short period of time required to transfer the image (approximately 10 to 20 seconds) will not permanently deform baseball 10. In fact, baseball 10 will typically return to approximately the same shape it had prior to being compressed.

Backing sheet 30 may also be used to transfer an image onto a curved surface through sublimation without compressing the object. For example, souvenir baseball 80 shown in FIG. 9 is produced by a method that involves cutting the stitching 86 associated with a target surface or flap 88 to separate that portion of the cover from the rest of the baseball. In this embodiment, apparatus 40 is provided with a die having a flat face in place of a die 44. Flap 88 is placed against the surface of the die rather than placing the entire ball in the die as is done with die 44. Backing sheet 30 with image 20 attached is utilized in the same manner as described above with ball 10. Lever 50 is actuated to bring the heated die plate up to the flap 88 as previously described for ball 10.

After heat has been applied to the image through backing sheet 30, a mirror image 92 of the image attached to backing sheet 30 is transferred through sublimation onto flap 88. As before, backing sheet 30 protects cover 84 of souvenir baseball 80 from heat damage. Once the image has been transferred to flap 88 and backing sheet 30 has been removed therefrom, flap 88 is reattached to core 90 so that baseball 80 retains its original appearance. Preferably, an adhesive is applied to the underside of flap 88 to reattach the flap to core 90. Alternatively, flap 88 could be restitched to baseball 80 to regain its original curvature.

If the image to be transferred is a color photocopy, either of the processes outlined above may be followed. However, the use of backing sheet 30 is optional. Regardless of whether sheet 30 is utilized, it has been found that the thermal transfer of an image from a photocopy to a curved object is enhanced by immersing the transferred image and photocopy paper in water and then alcohol immediately after heat has been applied. Preferably, the baseball and the photocopy paper, which are still attached to one another, are immersed in water at room temperature for about 10–30 seconds for the purpose of cooling the transferred image and transfer paper. Alternatively, the image and transfer paper could be cooled with ambient air, but air cooling would take considerably longer than a water bath. Finally, with the transfer paper still attached to the ball, the image and transfer paper are immersed in alcohol for approximately 5–10 seconds to chemically separate the transfer paper from the baseball and minimize any damage to the baseball and the transferred image. Although rubbing alcohol or the equivalent may be used for the bath, an extended alcohol bath may damage the cover of the baseball.

If backing sheet 30 is employed in transferring photocopy image 20 onto baseball 10, a second backing sheet may be clamped with sheet 30 for immersing baseball 10 into the water bath. Upon removing baseball 10 from apparatus 40, the second backing sheet (not shown) can be pressed against the surface of the baseball opposite backing sheet 30 so that the ball is sandwiched between the two backing sheets. Then, a clamp securing the two backing sheets in position provides a convenient means for holding the baseball as it is immersed in water. The clamp and backing sheets would then be removed prior to immersing the baseball and transfer paper in alcohol.

Figure 11:
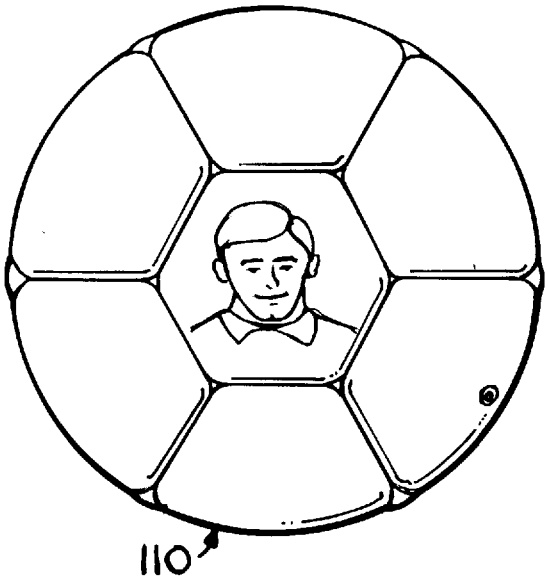
FIG. 11 is a perspective view of an inflatable souvenir soccer ball produced in accordance with a preferred embodiment of the present invention.

Although the disclosed embodiments describe a baseball as the double convex object to receive the image, other suitable objects may be used. For example, softballs (such as softball 100 shown in FIG. 10) or other similar balls could be used in addition to baseballs. Inflatable balls, such as a soccer ball 110 shown in FIG. 11 may also be utilized in either inflated or deflated condition for carrying out the method of the invention.

The quality of the image transferred to the object will often depend on the material covering the object. For a baseball, a vinyl cover has been found to work best with the present invention, but leather-covered baseballs also perform satisfactorily. Thus, the invention can be applied to any multiple curved object that is suitable for receiving an image through thermal transfer.

The quality of the image transferred to the object may also depend on the source of the original image. For example, it has been found that an image transferred onto a baseball from a photograph tends to fade more quickly over time than an image transferred onto a baseball from a photocopy. Whereas the cover of the baseball slowly absorbs the pigment transferred from the photograph, no significant fading has been observed after toner has been transferred onto a baseball from a photocopy.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A method for transferring an image onto an object having a surface which curves in two directions, said method comprising:

providing a generally planar image having a front side and a back side, wherein the front side contains pigment;

selecting a target surface for receiving the front side of said image;

aligning the image with the target surface so that the front side of the image faces the target surface;

moving the image toward a desired position on the target surface;

pressing the image against the target surface at the desired position;

heating the image so that the pigment can be transferred from the image to the target surface to produce a mirror image on the target surface;

attaching the back side of said image to a backing sheet;

aligning the backing sheet with the target surface so that the front side of the attached image faces the target surface;

moving the backing sheet with the attached image toward the desired position on the target surface; and pressing the backing sheet with the attached image against the target surface at the desired position.

2. The method of claim 1, wherein said pressing step includes compressing the object to substantially flatten the target surface.

3. The method of claim 2, further comprising reforming the object subsequent to said heating step so that the original curvature of the target surface is substantially obtained.

4. The method of claim 1, wherein said object is a baseball.

5. The method of claim 1, wherein said object is a softball.

6. The method of claim 1, wherein said object is an inflatable ball.

7. The method of claim 1, wherein said object has a vinyl cover.

8. The method of claim 1, wherein said object has a leather cover.

9. The method of claim 1, wherein said image is a color photocopy.

10. The method of claim 1, wherein the pigment includes text.

11. The method of claim 1, wherein said object has a core and a cover surrounding the core, said cover including one or more flaps held in place by stitching.

12. The method of claim 11, wherein the target surface is located on one of said flaps.

13. The method of claim 1, further comprising providing a label having a front side and a back side, wherein the front side contains text, and transferring said text to the target surface at approximately the same time the pigment is transferred to the target surface.

14. The method of claim 1, wherein said backing sheet is an aluminum backing sheet.

15. The method of claim 1, wherein said image is a color photograph.

16. The method of claim 15, wherein said pigment is transferred from the image to the target surface through sublimation.

17. The method of claim 1, wherein said target surface is a convex surface.

18. A method for transferring an image onto an object having a surface which curves in two directions, said method comprising:

providing a generally planar image having a front side and a back side, wherein the image is a color photocopy and the front side of the image contains pigment;

selecting a target surface for receiving the front side of said image;

aligning the image with the target surface so that the front side of the image faces the target surface;

moving the image toward a desired position on the target surface;

pressing the image against the target surface at the desired position;

heating the image so that the pigment can be transferred from the image to the target surface to produce a mirror image on the target surface; and immersing the mirror image in water subsequent to said heating step.

19. A method for transferring an image onto an object having a surface which curves in two directions, said method comprising:

providing a generally planar image having a front side and a back side, wherein the image is a color photocopy and the front side of the image contains pigment;

selecting a target surface for receiving the front side of said image;

aligning the image with the target surface so that the front side of the image faces the target surface;

moving the image toward a desired position on the target surface;

pressing the image against the target surface at the desired position;

heating the image so that the pigment can be transferred from the image to the target surface to produce a mirror image on the target surface; and immersing the mirror image in alcohol subsequent to said heating step.

20. A method for transferring an image onto an object having a surface which curves in two directions, said method comprising:

providing a generally planar image having a front side and a back side, wherein the front side contains pigment;

selecting a target surface for receiving the front side of said image;

aligning the image with the target surface so that the front side of the image faces the target surface;

moving the image toward a desired position on the target surface;

pressing the image against the target surface at the desired position;

heating the image so that the pigment can be transferred from the image to the target surface to produce a mirror image on the target surface;

wherein said object has a core and a cover surrounding the core, said cover including one or more flaps held in place by stitching;

wherein the target surface is located on one of said flaps; and cutting the stitching associated with said target surface and separating at least a portion of said one flap from the core to provide a substantially flattened target surface.

21. The method of claim 20, further comprising reforming the object subsequent to said heating step by replacing the stitching associated with said one flap.

22. The method of claim 20, further comprising reforming the object subsequent to said heating step by adhering the underside of the flap to the core.

* * * * *